US006261131B1

(12) United States Patent
Kuroda et al.

(10) Patent No.: US 6,261,131 B1
(45) Date of Patent: Jul. 17, 2001

(54) HIGH-VOLTAGE CONNECTOR

(75) Inventors: Keiji Kuroda, Amagasaki; Isao Kodani, Toyonaka, both of (JP)

(73) Assignee: J.S.T. Mfg. Co., LTD, Osaka (JP)

( * ) Notice: Subject to any disclaimer, the term of this patent is extended or adjusted under 35 U.S.C. 154(b) by 0 days.

(21) Appl. No.: 09/516,502

(22) Filed: Mar. 1, 2000

(30) Foreign Application Priority Data

Mar. 1, 1999 (JP) ..... 11-052355

(51) Int. Cl.[7] ..... H01R 15/00
(52) U.S. Cl. ..... 439/732; 439/79; 439/934
(58) Field of Search ..... 439/79, 281, 680, 439/682, 732, 924.1, 934

(56) References Cited

U.S. PATENT DOCUMENTS

| | | | | |
|---|---|---|---|---|
| 4,732,565 | * | 3/1988 | Ito et al. | 439/79 |
| 4,739,139 | * | 4/1988 | Ikeda | 200/294 |
| 5,127,839 | * | 7/1992 | Korsunsky et al. | 439/79 |
| 5,147,228 | * | 9/1992 | Miller et al. | 439/741 |
| 5,176,528 | * | 1/1993 | Fry et al. | 439/181 |
| 5,186,633 | * | 2/1993 | Mosser, III | 439/79 |
| 5,201,662 | * | 4/1993 | Roche | 439/79 |
| 5,660,555 | * | 8/1997 | Ito et al. | 439/278 |
| 5,876,222 | * | 3/1999 | Gardner et al. | 439/79 |
| 5,890,932 | * | 4/1999 | Muta | 439/682 |
| 6,045,372 | * | 4/2000 | Lian et al. | 439/83 |

* cited by examiner

*Primary Examiner*—Brian Sircus
*Assistant Examiner*—Thanh-Tam Le
(74) *Attorney, Agent, or Firm*—Antonelli, Terry, Stout & Kraus, LLP

(57) ABSTRACT

A high-voltage connector consists of a base connector mating a socket connector. The base connector (10) has: an insulated housing (11), input and output pin contacts (12, 13), and a partition (16) dividing the housing into compartments (18,19) to accommodate the pin contacts. The pin contacts respectively consists of front portions **(12*a*,13*a*) protruding into the housing's front opening (14) and rear portions (12*b*,13*b*) isolated by a middle rear extension (17) of the housing. The socket connector (30) has: a bifurcated housing (31), and a pair of socket contacts (32,33) held in this housing and securable on wire ends. The second housing is insertable into the front opening, causing the socket contacts to fit on the front portions. A recess (34) formed in the second housing is fittable on the partition, and two cylindrical chambers (35,36) formed in the housing (31) accommodate the socket contacts isolated and each lying on one side. One chamber (35) holding the input socket contact (12) is longer than the other chamber (36)**, such that the high-voltage connector contributes to the miniaturizing and thinning of the back-light inverters used with the liquid crystal panels, also improving high-voltage resisting property by virtue of elongated linear and spatial distances.

8 Claims, 6 Drawing Sheets

HIGH-VOLTAGE CONNECTOR

BACKGROUND OF THE INVENTION

1. Field of the Invention

The present invention relates to a high-voltage connector suited for use with electronic apparatuses driven with higher voltages, and more particularly to a connector used in the recent smaller-sized and thinned inverter boards (viz., circuit boards) serving as power supply circuits for the so-called back-light devices that operate as the light beam source for liquid crystal displays.

2. Prior Art

The current notebook type personal computers, for example, have been required to comprise as large liquid crystal displays as possible within a de-limited dimension which the computer body frames afford. Such enlarge displays have necessitated higher voltages amounting to 1000–1400 volts or so to activate the back-light illuminators. Since the printed inverter boards, viz., the power sources, for feeding electric energy to the back-lights have usually been set in those body frames, such larger displays have reduced the surface mount areas allotted to the printed inverter boards, causing same to be made smaller in size.

Connectors each electrically connecting the smaller-sized printed inverter board to the back-light device have thus to be smaller and nevertheless resistant to high voltages. The present applicant has therefore filed a patent application for an invention as disclosed in the Japanese Laying-Open Gazette No. 10-172649. In this preceding invention, linear and spatial distances between the contacts in the connector were increased so that it could withstand high voltages.

The term 'linear distance' used herein does define a distance measured along surfaces intervening between such contacts as disposed in combination with each other.

SUMMARY OF THE INVENTION

However, the current market more strongly demands the notebook type personal computers rendered much lighter in weight and much thinner in shape. An object of the present invention that was made to meet these requirements is therefore to provide a high-voltage connector that will not only ensure linear and spatial distances increased between the contacts but also will be rendered smaller in size and thinner in height, by improving the connector proposed in the Gazette No. 10-172649.

In order to achieve this object, a high-voltage connector that is provided herein consists of a base connector mating a socket connector, the base connector comprising: a first insulated housing with a front opening, an input pin contact and an output pin contact, both the pin contacts being held in the first housing, and a partition integral with and dividing the first housing into discrete compartments. The pin contacts are arranged in parallel with each other in the respective compartments, each pin contact consisting of a front portion protruding towards a mouth of the front opening and a rear portion protruding rearwards through a back wall of the first housing. The housing has a middle rear extension jutting backwards from the back wall of the first housing, wherein the rear portion of the input pin contact is bent down to assume an L-shape to thereby form a solderable end, and the rear portion of the output pin contact is bent sideways and outwards and further bent down to assume another L-shape to thereby form a solderable end. The rear portions are isolated from each other by the middle extension so as to ensure between said portions such linear and spatial distances as enhancing high-voltage resisting property of the base connector.

The socket connector comprises: a second insulated housing, and a pair of socket contacts held therein and securable on respective wire ends, the second insulated housing being insertable into the front opening of the first insulated housing through the mouth thereof so as to cause the socket contacts to fit on the front portions of the respective pin contacts. A recess formed in the second housing is adapted to fit on the partition of the base connector. A pair of cylindrical chambers are formed in the second housing and separated with the recess so as to render the second housing bifurcated, so that the chambers accommodate the respective socket contacts isolated from each other and each lying on one side thereof. One of the chambers that holds therein one of the socket contacts for the input pin contact is made longer than the other chamber holding the other socket contact for the output pin contact, whereby linear and spatial distances between the socket contacts are increase enough to enhance high-voltage resisting property of the socket connector.

Preferably, each chamber for the socket contact may have a side wall where a lance is disposed to force each socket contact to lie on its one side.

THE PREFERRED EMBODIMENTS

Figure 1:
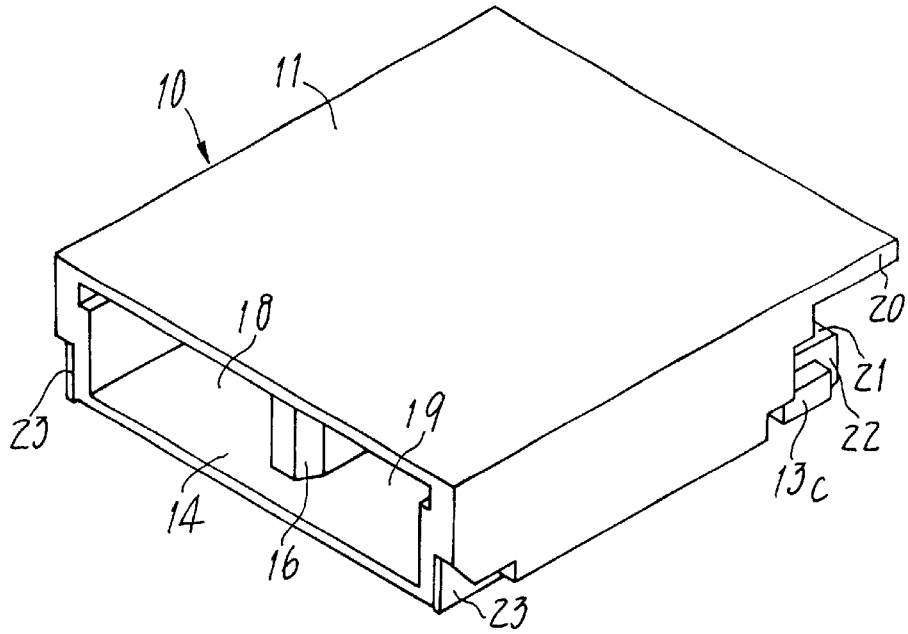
FIG. 1 is a frontal perspective view of a base connector provided herein to connect wires to a principal device not shown.

Some preferable embodiments of the present invention will now be described referring to the drawings.

Figure 2:
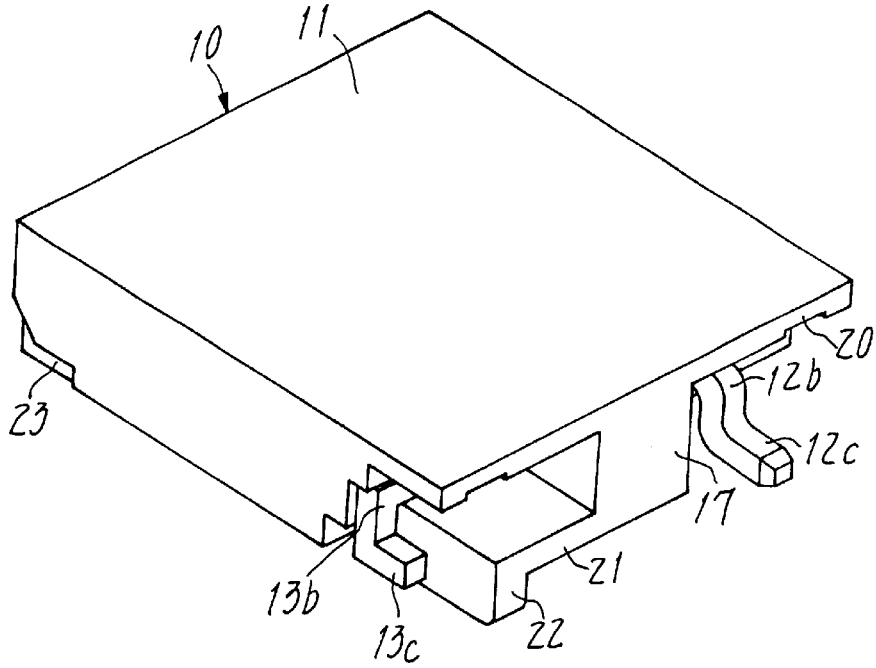
FIG. 2 is a rear perspective view of the base connector.
Figure 3:
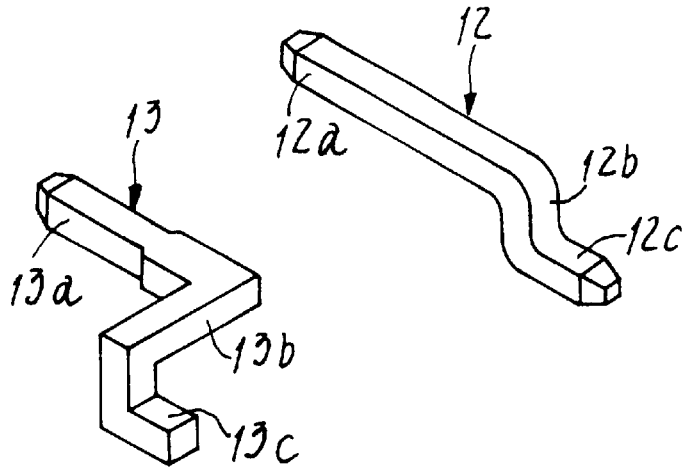
FIG. 3 is a perspective view of pin contacts incorporated in the base connector.
Figure 4:
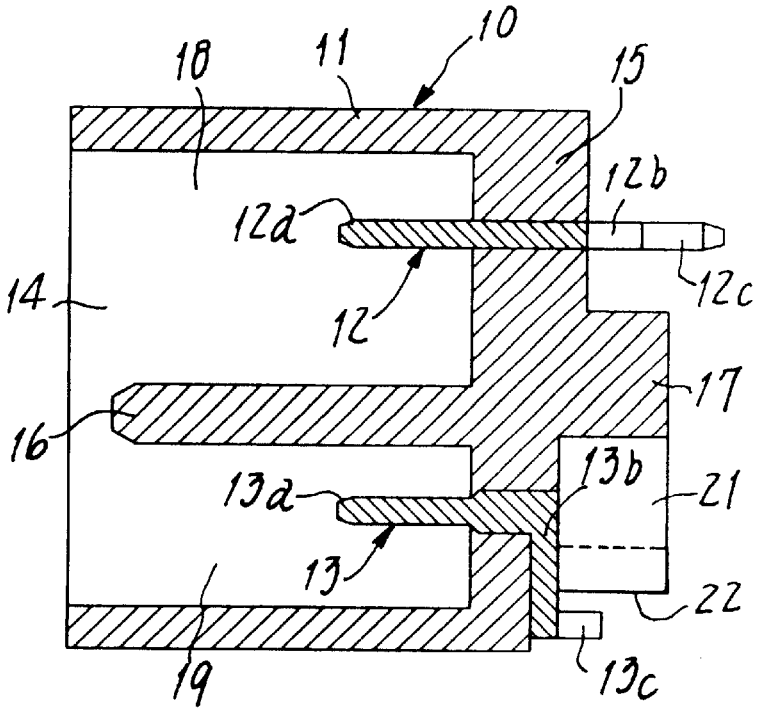
FIG. 4 is a horizontal cross section of the base connector.

FIGS. 1 to 4 illustrate as a whole a base connector 10 provided herein to connect wires to a principal electric device not shown. The base connector 10 comprises a depressed and rectangularly-cylindrical insulated housing 11. As seen in FIG. 4, an input pin contact 12 and an output pin contact 13 are secured in the housing such that their outer ends 12*a* and 13*a* lie therein in parallel with each other. The housing 11 has a front opening 14 and a back wall 15. A partition 16 extends from a middle portion of the back wall 15 towards a mouth of the opening 14. A middle rear extension 17 also juts backwards from the middle portion of the back wall. Discrete compartments 18 and 19 isolated with the partition 16 accommodate outer ends or portions 12*a* and 13*a* of the pin contacts 12 and 13. As best seen in FIG. 2, the summit of the rear middle extension 17 of the back wall is integral with a rear top extension 20 of the roof of the housing 11. The bottom of the middle extension 17 has a transverse extension 21 protruding sideways towards the output pin contact 13. A lower barrier 22 continues down from the end of the transverse extension 21.

The input pin contact 12 penetrates the back wall 15 of the housing 11 and fixed thereto. Its outer end 12*a* protrudes, in parallel with the axis of the housing 11, towards the opening's 14 mouth and into the compartment 18 so as to take a fixed position therein. The inner portion or end 12*b* of the input pin contact 12 juts rearwards from the back wall 15 and is bent down to assume an L-shape. An extremity of such a bent inner end is a solderable portion 12*c* that is to be soldered to a circuit board 26 (see FIG. 7).

The output pin contact 13 also penetrates the back wall 15 of the housing 11 and fixed thereto. Its outer portion or end 13*a* protrudes towards the opening's 14 mouth and into the compartment 19 so as to take a fixed position therein in parallel with the input pin contact's outer end 12*a*. The inner portion or end 13*b* of the output pin contact 13 is bent sideways away from the inner end of the input pin contact and along the rear face of the back wall, and is further bent down to assume an L-shape. An extremity of such a bent inner end is a solderable portion 13*c* that is to be soldered to the circuit board 26. Reinforcement metal pieces 23 solderable to the circuit board 23 are embedded in the opposite lateral sides of the opening 14 of the housing 11.

As described above, the back wall 15, the partition 16, the middle extension 17, the top extension 20, the transverse extension 21 and the lower barrier 22 do intervene between the input pin contact 12 and the output pin contact 13. This feature contributes to increased linear and spatial distances between those pin contacts, thereby enhancing high-voltage-resisting property. Thus, high-voltage will surely not cause any problems in spite of such a reduced distance between the outer ends 12*a* and 13*a* as to minimize the insulated housing 11 and the base connector per se in its entirety.

The inner or rear portion 12*b* of the input pin contact 12 protrudes straightly to be kept at a sufficient spatial distance from any neighboring devices. The inner or rear portion 13*b* of the output pin contact 13 that scarcely suffers from any high-voltage-caused problems transversely bends itself sideways is protrudes straightly. Its solderable end 13*c* is thus held at a position remote away an increased spatial distance from that 12*c* of the other pin contact 12, thus protecting these ends from high-voltages applied to between them.

Figure 5:
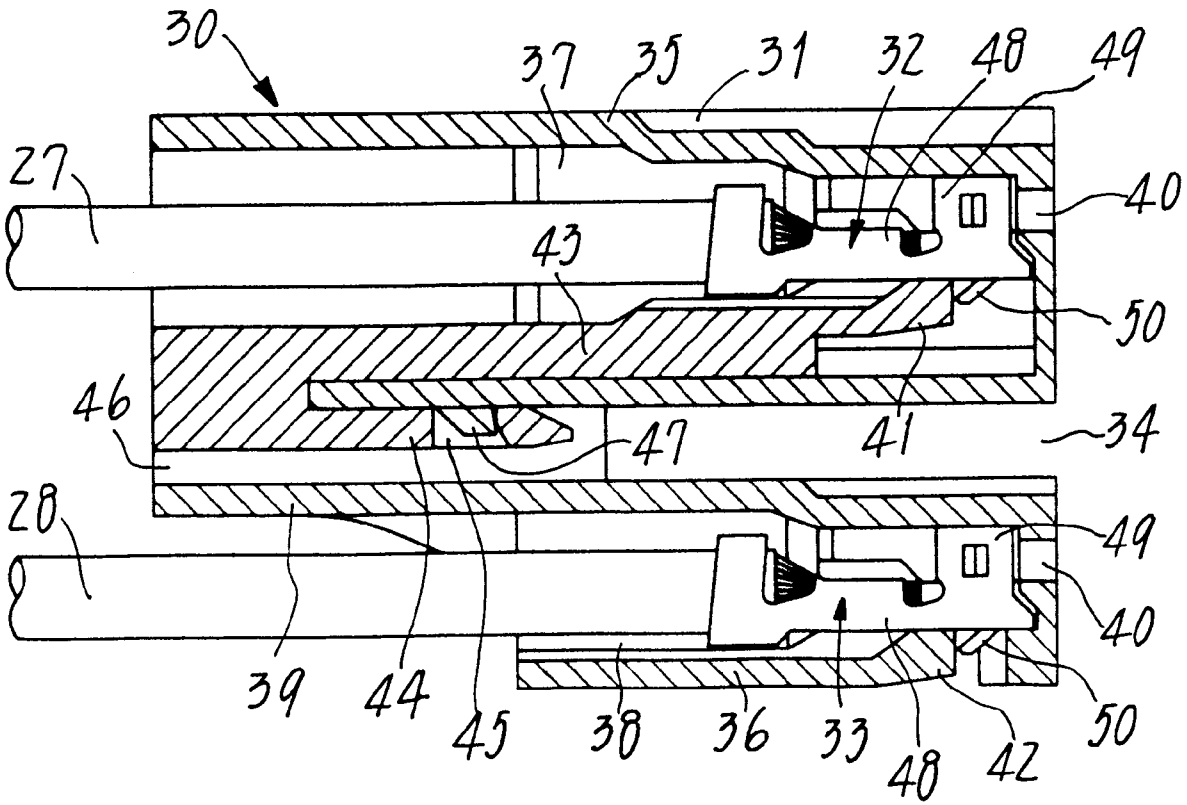
FIG. 5 is a horizontal cross section of a socket connector also provided herein.

FIG. 5 shows a socket connector 30 designed to fit in the base connector 10 and electrically connecting two wires 27 and 28 to the respective pin contacts 12 and 13. This connector 30 substantially consists of a second insulated housing 31 and two socket contacts 32 and 33. The housing 31 is shaped to fit in the opening 14 of the base connector, and the socket contacts are crimped on the ends of said wires 27 and 28 on one hand and are placed in the second housing separately from each other.

Figure 6:
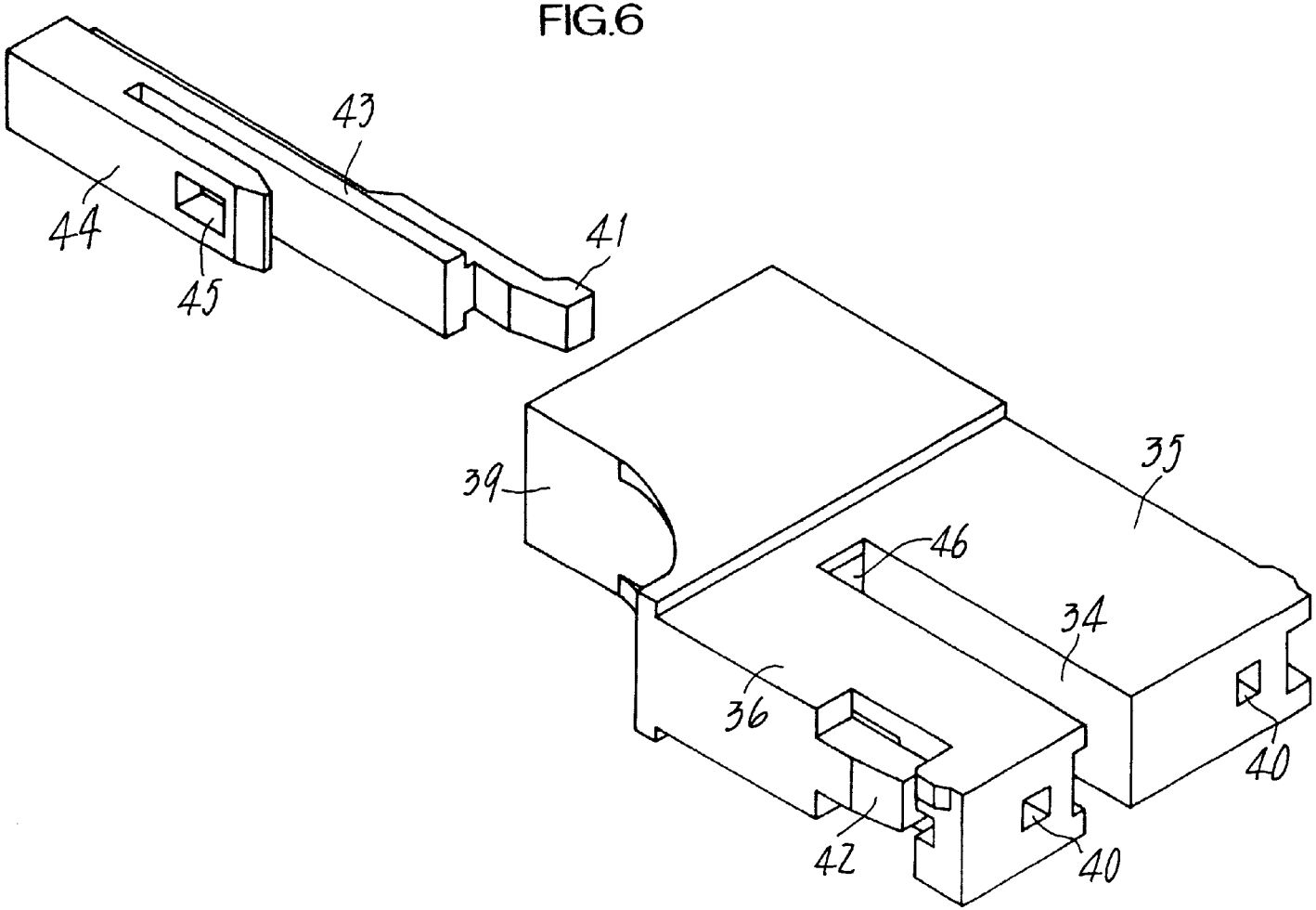
FIG. 6 is an exploded perspective view of an insulated housing of the socket connector.

The second insulated housing 31 has, as best seen in FIG. 6, a frontal half of an appearance like a depressed parallelopipedon. This half is also bifurcated consisting of a pair of rectangular cylinders 35 and 36 flat are isolated from each other with a recess 34 engageable with the partition 16 formed in the base connector 10. Those cylinders define therein respective chambers 37 and 38 for discrete accommodation of the socket contacts 32 and 33. One of those cylinders 35 for receiving the input side pin contact 12 is made longer enough than the other cylinder 36 to increase linear and spatial distances necessitated between the socket contacts for affording high-voltage resisting property. A hollow rear half 39 is integral with and unites the cylinders 35 and 36 to each other. Forward ends of those cylinders have apertures 40 to receive the outer ends 12*a* and 13*a* of the pin contacts. Lances 41 and 42 are disposed along or integral with lateral walls of those cylinders such that each socket contact 32 and 33 will lie on one of its sides. For convenience in molding the housing 31, one of the lances 41 is manufactured together with its elongate support 43 as a separate member discrete from said housing. This elongate support having its forward end formed as the lance 41 will be forced into the chamber 37, through the rear mouth thereof and along an inner wall thereof. A divisional space 46 present in the hollow rear half 39 is for reception of a parallel arm 44 continuing forward from the rear end of the support 43. A hole 45 formed in the forward end region of said and 44 will engage with a lug 47 jutting from the inner wall of the divisional space 46, so as to fix the lance 41 and support 43 together in the housing 31.

Each of the socket contacts 32 and 33 consists of a crimpable portion 48 to be crimped on the wire 27 or 28 and a socket portion 49 to engage with the outer end 12*a* or 13*a* of the pin contact 12 or 13. In order to render smaller in size and thickness of the whole socket connector 30, the length of each socket portion 49 is minimized and the socket contacts 32 and 33 are laid on their one sides within the rectangular cylinders 35 and 36. Such a shortened socket portion will make it difficult to provide it with an elongate lance, so that a short tongue 50 is formed integral with each socket portion to engage the lance 41 or 42.

In the socket connector 30 of the described structure, sufficient linear and spatial distances are ensured between its socket contacts 32 and 33 to improve high-voltage resisting property, while making the whole connector smaller and thinner.

Figure 7:
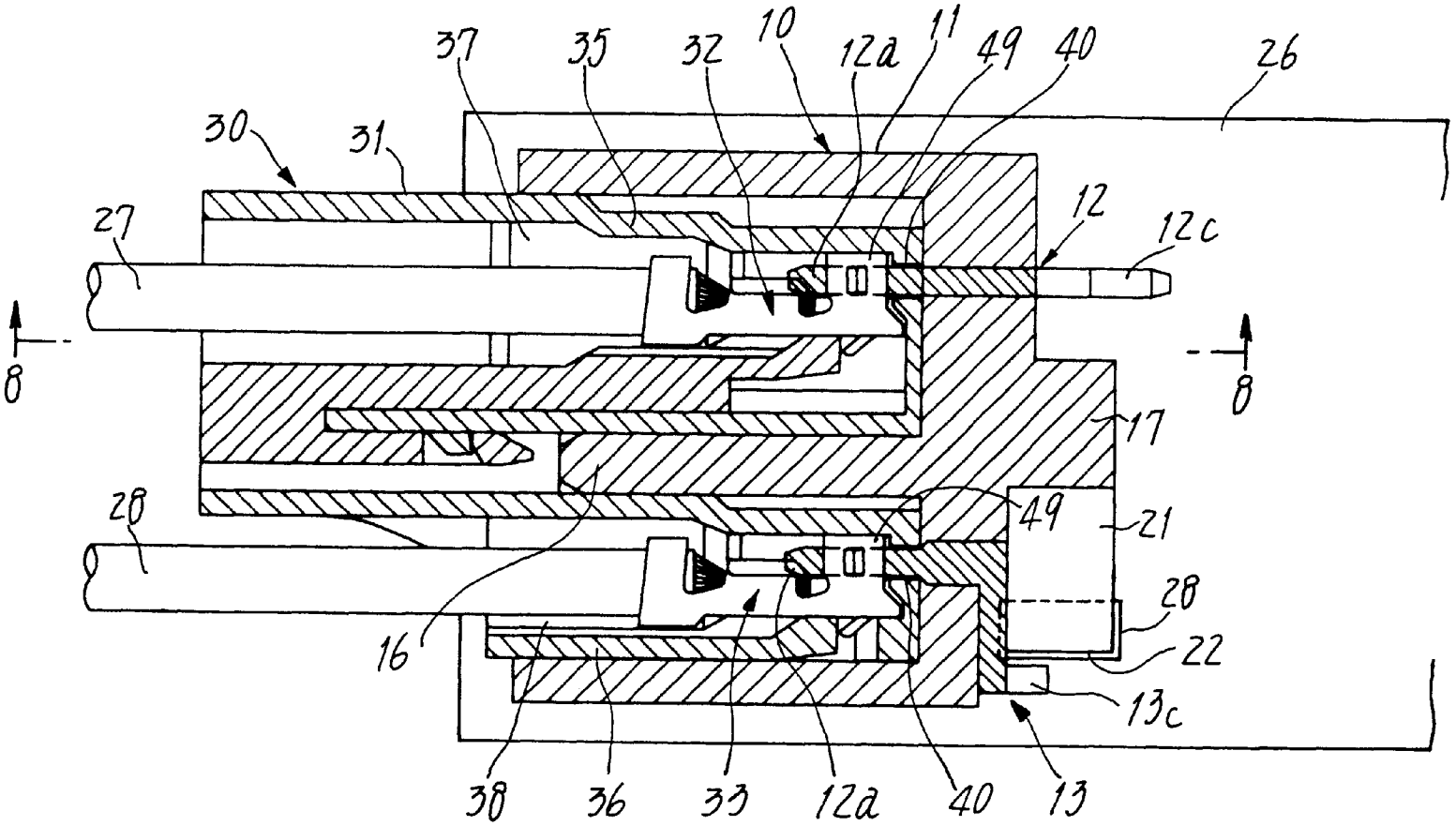
FIG. 7 is a plan view of the high-voltage connector in an exemplary use, shown partly in horizontal cross section.
Figure 8:
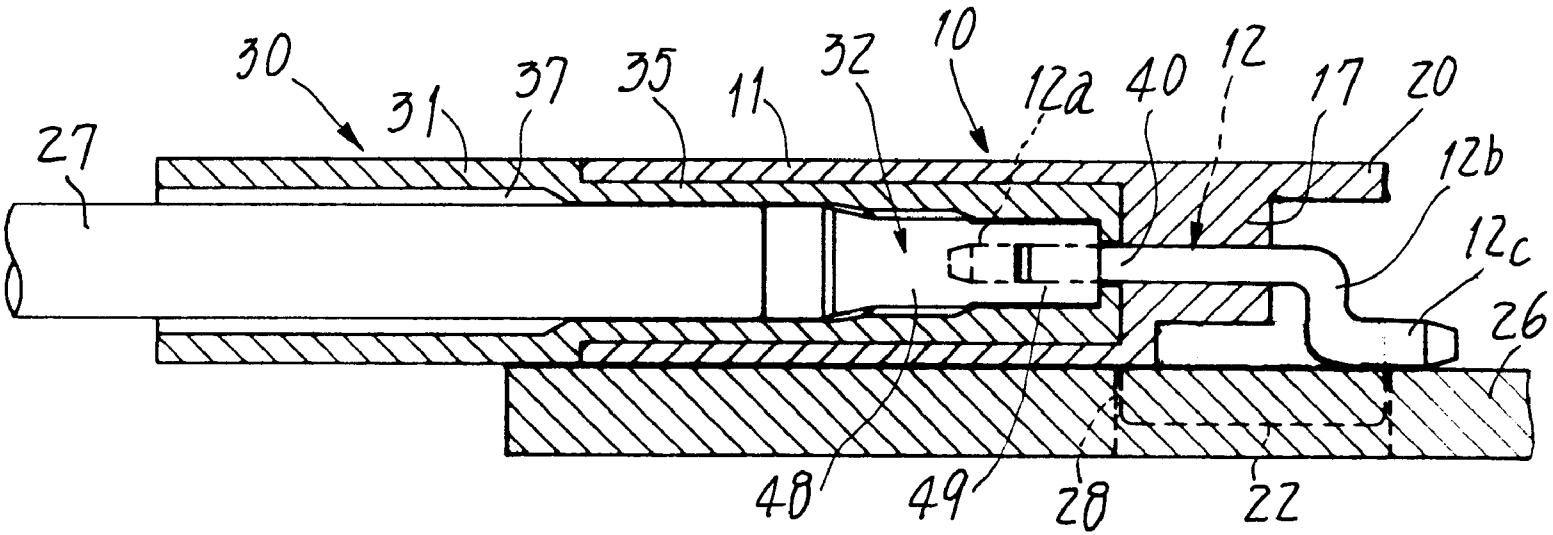
FIG. 8 is a cross section taken along the line 8—8 in FIG. 7.

FIGS. 7 and 8 show an exemplary use of a high-voltage connector composed of the described base connector 10 combined with the socket connector 30. The base connector is surface mounted on a peripheral zone of the circuit board 26, which constitutes an inverter power supply circuit used for the back-light of a liquid crystal panel. The solderable ends 12*a* and 13*a* of the input and output pin contacts 12 and 13 are soldered to a circuit pattern (not shown), bringing same into electric communication with those ends. Both the reinforcement metal pieces 23 are also soldered to the circuit board 26 to fix thereon the base connector 10. When mounting the connector onto the board, the lower barrier 22 protruding from the first insulated housing 11 will be put into a hole 26 formed in said board 26.

On the other hand, the two wires 27 and 28 are secured to the contacts 32 and 33 which the socket connector 30 has. Those wires are directed to and fixed on terminals (not shown) of the back-light device for the liquid crystal display. In use of this high-voltage connector, the rectangular cylinders 35 and 36 will be placed in the opening 14 which is present in the insulated housing 11 of the base connector 10, such that the recess 34 advance deep along the partition 16. In unison with such a movement, the outer ends 12*a* and 13*a* will respectively enter the cylinders 35 and 36, through the apertures 40, until fitting in the socket portions 49 of the socket contacts 32 and 33. As a result, the two wires 27 and 28 extending from the back-light device will be brought into electric communication with the power circuit on the board 26, via the socket and base connectors 30 and 10 arranged in this order.

It will now be apparent that the inverter power circuit constructed as above for back-light devices affords sufficient linear and spatial distances not only between the pin contacts 12 and 13 but also between the socket contacts 32 and 33. Such elongated distances will prevent a short-circuit or the like problems even if high voltages are applied to the back-light devices through the power supply circuit. In addition, Both the base and socket connectors 10 and 30 are now made so smaller and thinner as to facilitate it to render the inverter circuit also smaller and thinner.

In summary, the high-voltage connector provided herein and composed of such base and socket connectors will contribute to the miniaturizing and thinning of the back-light inverters used with the liquid crystal panels. Further, those elongated linear and spatial distances will improve the high-voltage resisting property of the circuits.

Thus, a high-voltage resisting, smaller and thinner power supply circuit of the inverter type is now provided.

What is claimed is:

1. A high-voltage connector consisting of a base connector mating a socket connector, the base connector comprising: a first insulated housing with a front opening, a first pin contact and a second pin contact, both the pin contacts being held in the first housing, a partition dividing the housing into discrete compartments, the pin contacts being arranged in parallel with each other in the respective compartments, each pin contact consisting of a front portion protruding toward a mouth of the front opening and a rear portion protruding rearwards through a back wall of the first housing, and a middle rear extension jutting backwards from the back wall of the first housing, wherein the rear portion of the first pin contact is bent down to assume a L-shape to thereby from a solderable end, and the rear portion of the second pin contact is bent sideways and outwards away from the first pin contact and further bent down to assume another L-shape to thereby form a solderable end of the rear portion of the second pin contact which is spaced a distance from the solderable end of the rear portion of the first pin contact greater than a distance between parallel front portions of the respective pin contacts, and wherein the rear portions are isolated from each other by the middle extension so as to ensure between said portions such increased linear and spatial distances as enhancing high-voltage resisting property of the base connector; and the socket connector comprising: a second insulated housing, a pair of socket contacts held therein and securable on respective wire ends, the second insulated housing being insertable into the front opening of the first insulated housing through the mouth thereof so as to cause the socket contacts to fit on the front portions of the respective pin contacts, a recess formed in the second housing and fittable on the partition of the base connector, and a pair of chambers formed in the second housing and separated with the recess from each other so as to render the second housing bifurcated and to accommodate the respective socket contacts isolated from each other and each lying on one side thereof, wherein one of the chambers that holds therein one of the socket contacts is made longer than the other chamber holding the other socket contact whereby linear and spatial distances are increased between the socket contacts to enhance high-voltage resisting property of the socket connector.

2. A high-voltage connector as defined in claim 1, wherein each chamber for the socket contact has a side wall where a lance is disposed to force each socket contact to lie on its one side.

3. A high-voltage connector as defined in claim 1, wherein the first pin contact is an input pin contact and the second pin contact is an output pin contact.

4. A high-voltage connector as defined in claim 3, wherein the one chamber which is made longer than the other chamber holds therein the socket contact for the first pin contact.

5. A high-voltage connector as defined in claim 1, wherein the one chamber which is made longer than the other chamber holds therein the socket contact for the first pin contact.

6. A high-voltage connector as defined in claim 1, wherein the base connector further comprises a top extension extending from a top of the first housing and jutting backwards from the back wall of the first housing.

7. A high-voltage connector as defined in claim 1, wherein the rear portion of the first pin contact extends backwards further than the rear portion of the second pin contact.

8. A high-voltage connector as defined in claim 7, wherein the middle rear extension juts backwards further than the rear portion of the second pin contact.

* * * * *